US009955790B2

(12) United States Patent
Tang

(10) Patent No.: US 9,955,790 B2
(45) Date of Patent: May 1, 2018

(54) FOLDING STOOL

(71) Applicant: WUXI HOUSETEX INDUSTRIES CO., LTD, Wuxi (CN)

(72) Inventor: Hongyan Tang, Wuxi (CN)

(73) Assignee: WUXI HOUSETEX INDUSTRIES CO., LTD, Wuxi (CN)

( * ) Notice: Subject to any disclaimer, the term of this patent is extended or adjusted under 35 U.S.C. 154(b) by 78 days.

(21) Appl. No.: 15/156,340

(22) Filed: May 17, 2016

(65) Prior Publication Data

US 2016/0255962 A1 Sep. 8, 2016

Related U.S. Application Data

(63) Continuation of application No. PCT/CN2014/079566, filed on Aug. 8, 2014.

(30) Foreign Application Priority Data

Jan. 22, 2014 (CN) ..... 2014 1 0028969

(51) Int. Cl.

| | |
|---|---|
| ***A47C 13/00*** | (2006.01) |
| ***A47C 4/52*** | (2006.01) |
| ***A47C 9/10*** | (2006.01) |
| ***A47C 7/48*** | (2006.01) |
| ***A47C 7/40*** | (2006.01) |

(52) U.S. Cl.

CPC ..... *A47C 13/00* (2013.01); *A47C 4/52* (2013.01); *A47C 7/407* (2013.01); *A47C 7/48* (2013.01); *A47C 9/10* (2013.01)

(58) Field of Classification Search

CPC ..... A47C 13/00; A47C 4/52; A47C 7/407; A47C 7/48; A47C 9/10

USPC ..... 297/105, 118, 378.1, 452.57; 16/366, 16/368, 369

See application file for complete search history.

(56) References Cited

U.S. PATENT DOCUMENTS

| | | | | |
|---|---|---|---|---|
| 3,004,792 A * | 10/1961 | Bell | A47C 7/407 297/118 |
| 3,747,977 A * | 7/1973 | Rowland | A47C 4/02 297/452.16 |
| 5,597,199 A * | 1/1997 | Hoffman | A47C 7/62 297/119 |
| 8,627,523 B2 * | 1/2014 | Kaiser | A47C 19/022 297/230.1 |
| 2009/0013500 A1 * | 1/2009 | Ueyama | G06F 1/1616 16/354 |
| 2009/0261643 A1 * | 10/2009 | Kay | A47C 4/20 297/335 |

* cited by examiner

*Primary Examiner* — Syed A Islam
(74) *Attorney, Agent, or Firm* — Wayne & King LLC

(57) ABSTRACT

A folding stool comprises a seat portion, a backrest and a hinge device connecting the seat portion and the backrest. The hinge device comprises a first hinge and a second hinge rotatably connected. Two first hinges are respectively fixed to the backrest and the seat portion, the first hinge comprises two ear portions, the second hinge comprises four ear portions, and the four ear portions of the second hinge are respectively connected to four ear portions of the two first hinges by means of two rotary shafts. A position limiting board is fixed on the back surface of the second hinge, and the position limiting board comprises two oppositely provided position limiting surfaces.

6 Claims, 12 Drawing Sheets

FOLDING STOOL

CROSS-REFERENCE TO RELATED APPLICATIONS

This application is a continuation of International Patent Application No. PCT/CN2014/079566 with an international filing date of Aug. 8, 2014, designating the United States, now pending, and further claims priority benefits to Chinese Patent Application No. 201410028969.X, filed Jan. 22, 2014. The contents of all of the aforementioned applications, including any intervening amendments thereto, are incorporated herein by reference.

FIELD OF THE INVENTION

The present application relates to the field of chairs and stools, specifically to folding stools, and more particularly to a folding stool with the dual function of a chair and a stool.

BACKGROUND OF THE INVENTION

At present, most of the folding stools in the market are designed to make the seat portion of the chair or of the stool foldable. For the stool without a backrest, it generally comprises a seat portion, a stool cover covered on the seat portion and a supporting board for supporting the shape of the seat portion. The seat portion is designed to be foldable, and when folding, it only needs to take out the supporting board and then folding the seat portion to realize the folding function of the seat portion. However, for the chair with a backrest, the backrest is non-foldable since the backrest is generally fixed to the seat portion via a fixing connection, for example bolts, and the backrest is vertical to the seat portion all the time. Therefore, after the supporting boards in the stool cover and the seat portion are taken out to fold the seat portion, it still needs a large space to store the folded chair since the backrest is non-foldable and is fixed to the seat portion.

SUMMARY OF THE INVENTION

Aiming at above problem in the prior, the applicant makes research and improvement to provide a folding stool and a folding mechanism thereof so as to make the backrest foldable, thus the stool cover and the backrest can be stored as a whole to reduce space occupied and facilitate transportation and storage.

The technical solution of the present application for solving the technical problems is as follows:

A folding stool comprises a seat portion and a backrest, the backrest consists of a soft surface layer and a hard sandwich board wrapped in the soft surface layer, the seat portion is a cuboid, and both an upper surface and four side surfaces of the cuboid consist of the soft surface layer and the hard sandwich board wrapped in the soft surface layer, a first hard sandwich board in the backrest is connected to a second hard sandwich board under the upper surface of the seat portion via a hinge device, the hinge device comprises a first hinge and a second hinge that are connected to each other rotatably, two first hinges are respectively fixed on the second hard sandwich board and the first hard sandwich board, the first hinge comprises two ear portions provided along a longitudinal direction, the second hinge comprises four ear portions provided symmetrically along the longitudinal direction and a transverse direction, two ear portions of the first hinge on the second hard sandwich board are connected to two ear portions provided along the longitudinal direction and located at a same side of the second hinge by means of a rotary shaft, two ear portions of the first hinge on the first hard sandwich board are connected to the other two ear portions provided along the longitudinal direction of the second hinge by means of another rotary shaft, a position limiting board is fixed on a back surface of the second hinge, the position limiting board comprises two longitudinal position limiting surfaces opposite to each other, and when the backrest is rotated to be perpendicular to the upper surface of the seat portion via the hinge device, the two longitudinal position limiting surfaces of the position limiting board are respectively used to limit the rotation of the second hinge and the first hinge on the first hard sandwich board.

In a further technical solution:

One of the two ear portions of the first hinge is arranged between two ear portions provided in the longitudinal direction of the second hinge, the other one of the two ear portions of the first hinge is arranged outside corresponding ear portions of the second hinge, and positional relationship between the ear portions of the first hinge on the first hard sandwich board and the corresponding ear portions of the second hinge is the same as that between the ear portions of the first hinge on the second hard sandwich board and the corresponding ear portions of the second hinge.

The first hinge is a groove structure, the two ear portions are defined on two side walls of the groove structure and are defined on end portions of the two side walls, a bottom of the groove structure is a connection portion, connection portions of two first hinges are respectively fixed to the second hard sandwich board and the first hard sandwich board, and an end surface of the groove structure located at a same side with the two ear portions are arranged correspondingly to the longitudinal position limiting surface on the position limiting board.

The second hinge is an H-shaped structure, the four ear portions are symmetrically defined on two parallel walls of the H-shaped structure and are defined on four end portions of the two parallel walls, a vertical connection portion is arranged between the two parallel walls, a width of the vertical connection portion is less than a distance between two ear portions defined on a single parallel wall, a height of the two parallel walls is greater than a height of the vertical connection portion, and after the first hinge and the second hinge are connected via the rotary shaft, the ear portions of the first hinge is above the vertical connection portion.

The seat portion comprises stool cover, a stool body and supporting board, the stool body is a hollow cuboid when it is unfolded, each of the four side surfaces of the cuboid consisting of the soft surface layer and the hard sandwich board wrapped in the soft surface layer, the hollow cuboid is defined with an upper opening, a bottom of the hollow cuboid is the soft surface layer, the stool cover is formed of the soft surface layer and the hard sandwich board wrapped in the soft surface layer, the stool cover is covered on the unfolded stool body, and the supporting board is supported in the unfolded stool body.

A plurality of first mounting through-holes are defined in the soft surface layer at the bottom of the stool body, a plurality of second mounting through-holes are defined in the supporting board, threads are defined on the second mounting through-holes, a pull ring is defined on the supporting board, and the first and second mounting through-holes are arranged correspondingly for mounting bolts in supporting legs.

A gap region is defined between four hard sandwich boards in the four side surfaces of the hollow cuboid, the gap region is wrapped in the soft surface layer, there are at least two adjacent hard sandwich boards among the four hard sandwich boards are formed by two separate boards, and a notch and a fold line are defined between the two separate boards.

The advantageous effects of the present invention are as follows:

By arranging a special hinge device between the hard sandwich board in the backrest and the hard sandwich board in the stool cover to realize the rotatable connection therebetween, the backrest is hence foldable. Meanwhile, by arranging the position limiting board at the back side of the hinge device, the range of the rotating angle of the backrest can be controlled by the position limiting surface of the position limiting board, and the end surfaces of the two first hinges mounted respectively on the hard sandwich board in the backrest and the hard sandwich boards in the stool cover, thus the backrest can be controlled to be perpendicular to the stool cover when it is unfolded to function as back support for rest. When the backrest is folded, it covers on the stool cover in parallel and the stool and the backrest can be stored as a whole to reduce the space occupied and facilitate transportation and storage. Moreover, under the tolerance of the rotary shaft to applied force, the folded folding stool can also function as a simple stool. The folding stool in the present application not only realizes folding function, occupies less space, but also realizes collecting function with a large storage space since it forms a hollow cuboid when it is unfolded, the process for manufacturing hard sandwich board is very simple, and the folding stool is economical and practical.

In the accompanying drawing: 1, seat portion; 101, second hard sandwich board; 102, stool cover; 103, stool body; 1031, first mounting through-holes; 1032, notch; 1033, folding line; 1034, gap region; 104, supporting board; 1041, second mounting through-holes; 1042, pull ring; 105, supporting leg; 1051, bolt; 1052, leg body; 1053, friction pad; 2, backrest; 201, first hard sandwich board; 3, first hinge; 301, side wall; 302, connection portion; 303, end surface; 4, second hinge; 401, parallel wall; 402, vertical connection portion; 5, rotary shaft; 6, position limiting board; 601, position limiting surface.

DETAILED DESCRIPTION OF THE PREFERRED EMBODIMENT

The specific implementation of the present invention will be described with the accompanying drawings.

Figure 1:
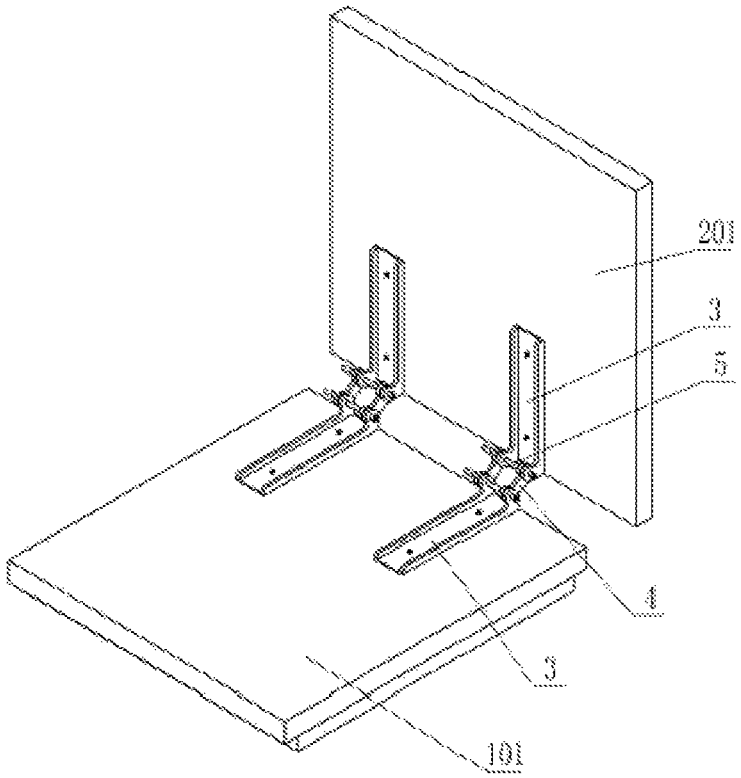
FIG. 1 is 3D view showing a hard sandwich board in a backrest connected to a hard sandwich board in a seat portion via a hinge device according to the present invention, the backrest is in an unfolded state in the figure.
Figure 2:
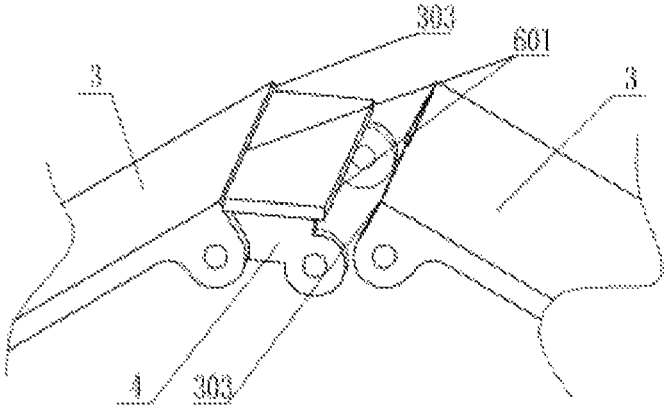
FIG. 2 is an exploded view showing the back of the hinge device according to the present invention, two first hinges are not completely shown in the figure.
Figure 5:
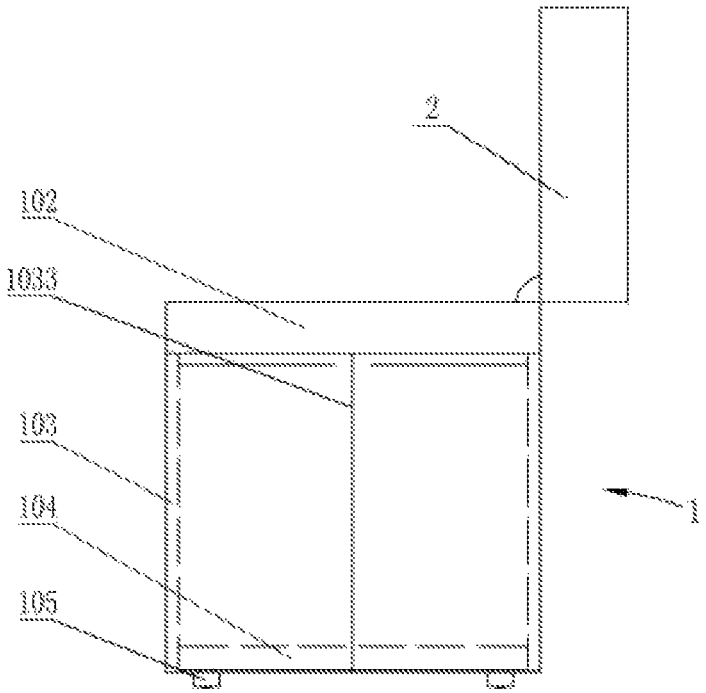
FIG. 5 is a front view of a folding stool according to the present invention, the hinge device in the figure is wrapped with a soft surface layer.
Figure 6:
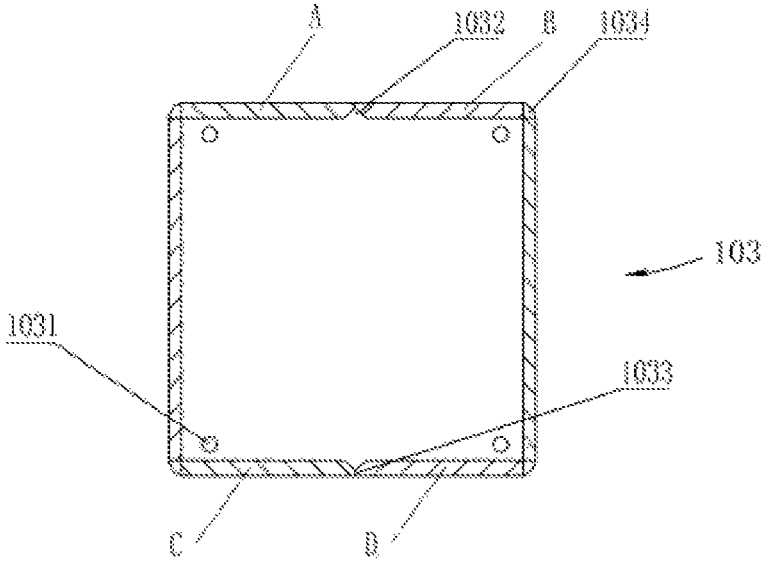
FIG. 6 is a top and section view of the seat portion according to the present invention.

As shown in FIGS. 5 and 6, the folding stool according to a preferred embodiment of the present invention comprises a seat portion 1 and a backrest 2. The backrest 2 consists of a soft surface layer and a hard sandwich board wrapped in the soft surface layer. The seat portion 1 is a cuboid. Both an upper surface and four side surfaces of the cuboid consist of the soft surface layer and the hard sandwich board wrapped in the soft surface layer. As shown in FIG. 1, a first hard sandwich board 201 in the backrest 2 is connected to a second hard sandwich board 101 under the upper surface of the seat portion 1 via a hinge device. The hinge device comprises a first hinge 3 and a second hinge 4 that are connected to each other rotatably. Two first hinges 3 are respectively fixed on the second hard sandwich board 101 and the first hard sandwich board 201. The first hinge 3 comprises two ear portions provided along a longitudinal direction. The second hinge 4 comprises four ear portions provided symmetrically along the longitudinal direction and a transverse direction. Two ear portions of the first hinge 3 on the second hard sandwich board 101 are connected to two ear portions provided along the longitudinal direction and located at a same side of the second hinge 4 by means of a rotary shaft 5. Two ear portions of the first hinge 3 on the first hard sandwich board 201 are connected to the other two ear portions provided along the longitudinal direction of the second hinge 4 by means of another rotary shaft 5. As shown in FIG. 2, a position limiting board 6 is fixed on a back surface of the second hinge 4, the position limiting board 6 comprises two longitudinal position limiting surfaces 601 opposite to each other, and when the backrest 2 is rotated to be perpendicular to the upper surface of the seat portion 1 via the hinge device, the two longitudinal position limiting surfaces 601 of the position limiting board 6 are respectively used to limit the rotation of the second hinge 4 and the first hinge 3 on the first hard sandwich board 201.

Specifically, as shown in FIG. 1, one of the two ear portions of the first hinge 3 is arranged between two ear portions provided in the longitudinal direction of the second hinge 4, the other one of the two ear portions of the first hinge 3 is arranged outside corresponding ear portions of the second hinge 4, and positional relationship between the ear portions of the first hinge 3 on the first hard sandwich board and the corresponding ear portions of the second hinge 4 is the same as that between the ear portions of the first hinge 3 on the second hard sandwich board and the corresponding ear portions of the second hinge 4. That is to say, for the other first hinge 3, one of the two ear portions of the first hinge 3 is arranged between two ear portions provided in the longitudinal direction of the second hinge 4, the other one of the two ear portions of the first hinge 3 is arranged outside corresponding ear portions of the second hinge 4.

Figure 3:
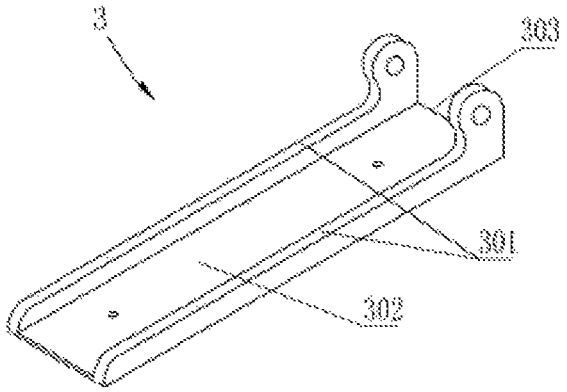
FIG. 3 is a 3D view of the first hinge according to the present invention.
Figure 4:
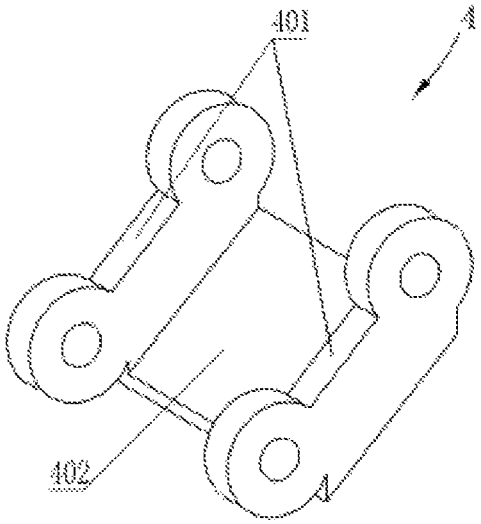
FIG. 4 is a 3D view of a second hinge according to the present invention.

Specifically, as shown in FIGS. 2 and 3, the first hinge 3 is a groove structure. The two ear portions are defined on two side walls 301 of the groove structure and are defined on end portions of the two side walls 301. A bottom of the groove structure is a connection portion 302, connection portions 302 of two first hinges 3 are respectively fixed to the second hard sandwich board 101 and the first hard sandwich board 201, and an end surface 303 of the groove structure located at a same side with the two ear portions are arranged correspondingly to the longitudinal position limiting surface 601 on the position limiting board 6. As shown in FIG. 4, the second hinge 4 is an H-shaped structure. The four ear portions are symmetrically defined on two parallel walls 401 of the H-shaped structure and are defined on four end portions of the two parallel walls 401. A vertical connection portion 402 is arranged between the two parallel walls 401, a width of the vertical connection portion 402 is less than a distance between two ear portions defined on a single parallel wall 401, a height of the two parallel walls 401 is greater than a height of the vertical connection portion 402, and after the first hinge 3 and the second hinge 4 are connected via the rotary shaft 5, the ear portions of the first hinge 3 is above the vertical connection portion 402.

In the folding stool of the present invention, a plurality of the hinge devices can be arranged between the first hard sandwich board 201 in the backrest 1 and the second hard sandwich board 101 in the stool cover 102.

Figure 7:
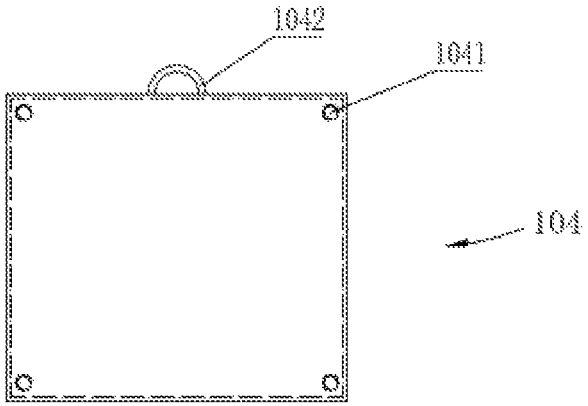
FIG. 7 is a top view of a supporting board according to the present invention.
Figure 8:
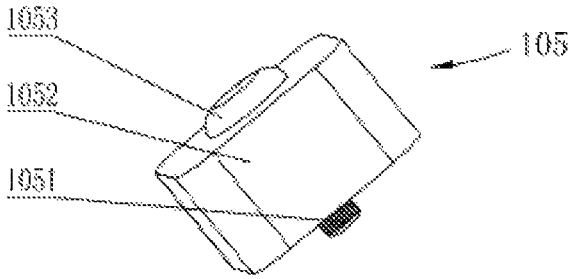
FIG. 8 is a 3D view of supporting legs according to the present invention.
Figure 9:
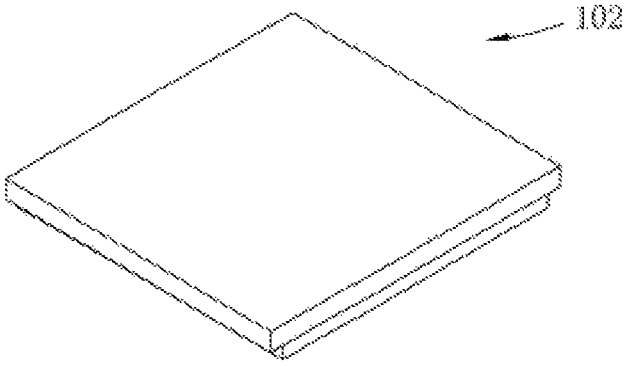
FIG. 9 is a 3D view of a stool cover according to the present invention.

Further, the seat portion 1 of the folding stool according to the present invention can be designed to be a foldable structure. As shown in FIGS. 5 and 6, the seat portion 1 comprises stool cover 102, a stool body 103 and a supporting board 104. The stool body 103 is a hollow cuboid when it is unfolded, each of the four side surfaces of the cuboid consisting of the soft surface layer and the hard sandwich board wrapped in the soft surface layer. The hollow cuboid is defined with an upper opening. A bottom of the hollow cuboid is the soft surface layer. The stool cover 102 is formed of the soft surface layer and the hard sandwich board wrapped in the soft surface layer, the stool cover 102 is covered on the unfolded stool body 103, and the supporting board 104 is supported in the unfolded stool body 103. A plurality of first mounting through-holes 1031 are defined in the soft surface layer at the bottom of the stool body 103, as shown in FIG. 7, a plurality of second mounting through-holes 1041 are defined in the supporting board 104, threads are defined on the second mounting through-holes 1041, a pull ring 1042 is defined on the supporting board 104, and the first and second mounting through-holes 1031 and 1041 are arranged correspondingly for mounting bolts 151 in supporting legs 105. As shown in FIG. 8, the supporting leg 105 comprises a leg body 1052, a bolt 1051 mounted in one end of the leg body 1052, and a friction pad 1053 mounted in the other end of the leg body 1053. The 3D view of the stool cover 102 is shown in FIG. 9. The stool cover 102 is formed by a cover roof and cover wall connected to the cover roof. The cover roof and the cover wall both consist of the soft surface layer and the hard sandwich board wrapped in the soft surface layer.

As shown in FIG. 6, a gap region 1034 is defined between four hard sandwich boards in the four side surfaces of the hollow cuboid. The gap region 1034 is wrapped in the soft surface layer, so that the seat portion is foldable. There are at least two adjacent hard sandwich boards among the four hard sandwich boards are formed by two separate boards, and a notch 1032 and a fold line 1033 are defined between the two separate boards to facilitate the folding of the two boards.

The mounting process of the folding stool of the present invention is as follows: firstly, putting the supporting board 104 into the stool body 103 as shown in FIG. 5, adjusting the supporting board 104 to make the second mounting through-holes 1041 be corresponding to the first mounting through holes 1031, and making the bolts 1051 in the supporting legs 105 pass through the first mounting through-holes 1031 and be connected to the second mounting through-holes 1041 via threaded connection, thus the supporting board 104 is connected to the bottom of the stool body 103 (the volume of the supporting board 104 is less than the volume of the hollow cuboid formed by unfolding the stool body). Secondly, as shown in FIG. 1, connecting the first hard sandwich board 201 in the backrest 2 to the second hard sandwich board 101 in the stool cover 102 via the hinge device and wrapping the two hard sandwich boards with the soft surface layer, thus the backrest 2 and the stool cover 102 is formed as a whole; then covering the stool cover 102 on the stool body 103 to finish the mounting process of the present invention.

The using process of the folding stool of the present invention is as follows:

The unfolding of the backrest 2: as shown in FIG. 5, FIG. 5 shows that the backrest 2 is unfolded to a largest angle. In a preferred embodiment of the present invention, the backrest 2 is unfolded to a position vertical to the stool cover 102 when reaching the largest angle. The specific operations are as follows: keeping the stool cover 102 in the initial position, i.e. the stool cover 102 is covered on the unfolded stool body 103; rotating the backrest 2 upward to unfold it since the second hinge 4 is rotately connected to the first hinge 3 on the stool cover 102 and the first hinge 3 on the backrest 2 respectively under the reaction of the hinge device. Due to the arrangement of the position limiting board 6, when the backrest 2 is unfolded to the position perpendicular to the stool cover 102, the end surface 303 located at the same side with the ear portions of the first hinge 3 on the stool cover 102 resists the corresponding position limiting surface 601 of the position limiting board 6 since the stool cover 102 is unmoving, thus the position limiting board 6 is limited to a position with a certain angle. At this moment, the position limiting surface 601 at the other side of the position limiting board 6 just resists the end surface 303 located at the same side with the ear portions of the first hinge 3 on the backrest 2. Therefore, the backrest 2 is limited to the position perpendicular to the stool cover 102. When the backrest is unfolded, the whole folding stool has the function of back rest, and can be used as a chair.

Figure 10:
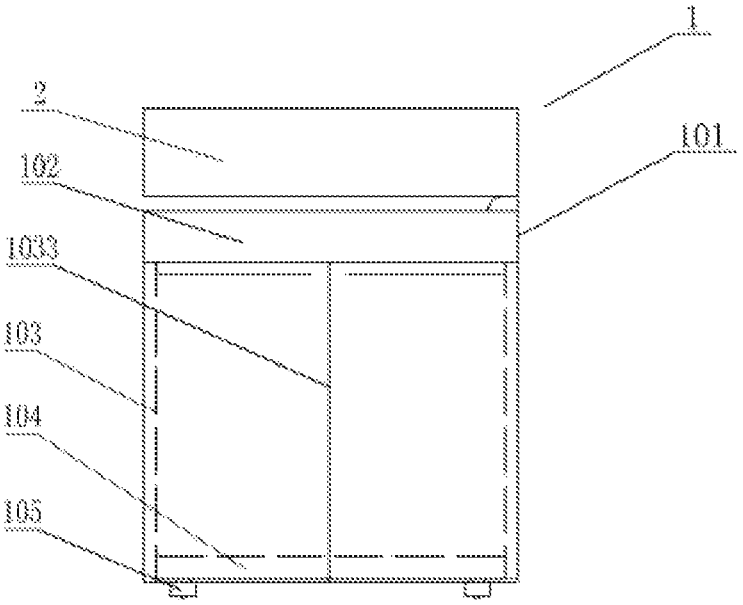
FIG. 10 is a view showing the backrest in a folded state according to the present invention.

The folding of the backrest 2: under the reaction of the hinge device, the backrest 2 can be folded by rotating the backrest 2 reversely. When rotating the backrest 2 downward, the backrest will be rotated downward to cover on the stool cover 102 in parallel since the position limiting surface 601 of the position limiting board 6 close to the stool cover 102 is gradually away from the end surface 303 located at the same side with the ear portions of the first hinge 3 on the stool cover 102, and the position limiting surface 601 of the position limiting board 6 close to the backrest 2 is gradually away from the end surface 303 located at the same side with the ear portions of the first hinge 3 on the backrest 2. At this moment, since the stool cover 102 still keeps unmoved in the initial position and a longitudinal ear portion located at the same side of the second hinge 4 is arranged between the two ear portions of the first hinge 3, the connection portion 302 of the first hinge 3 limits the rotation of the second hinge 4, i.e. the backrest 2 is limited to the position that the backrest 2 covers on the stool cover 102 in parallel. The vertical connection portion 402 and the position limiting board 6 are both vertical to the stool cover 102, and after the backrest 2 is folded, the whole folding stool can not function as back rest, but can function as a simple stool under the tolerance of the rotary shaft to applied force. At this moment, the backrest 2 takes place of the stool cover 102 to function as a seat surface. Since the backrest 2 is folded on the stool cover 102, the stool cover 102 and the backrest 2 can stored as a whole to reduce the space occupied and facilitate transportation and storage. The folded state of the backrest 2 is shown in FIG. 10.

Figure 11:
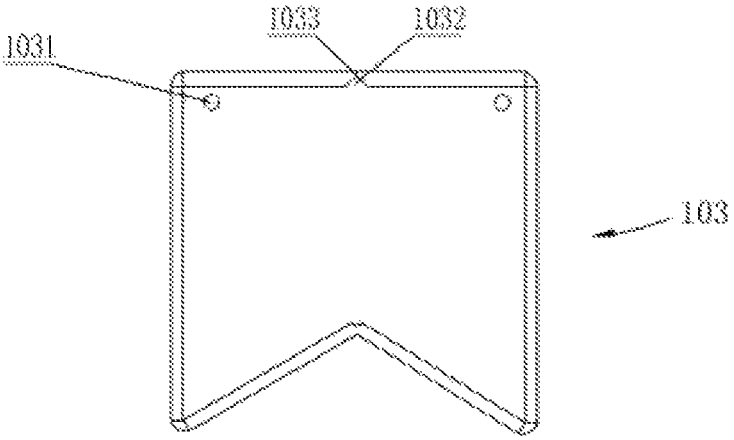
FIG. 11 is a first view showing the seat portion in a folded state according to the present invention.
Figure 12:
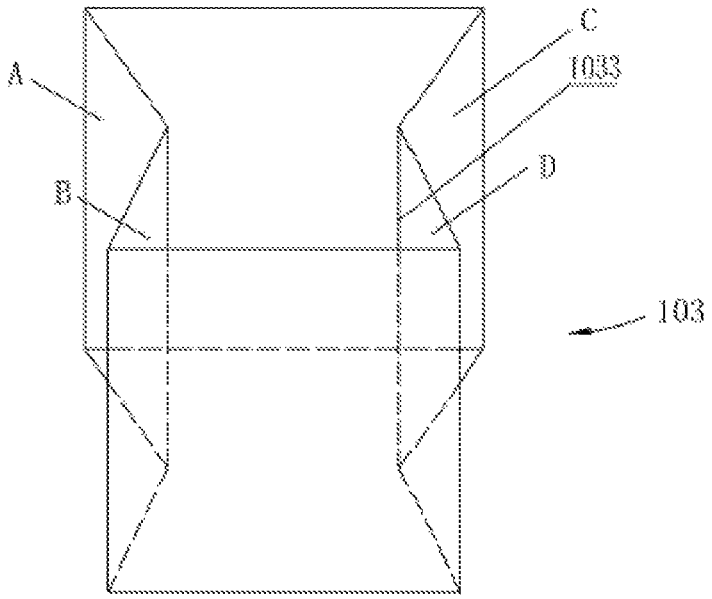
FIG. 12 is a second view showing the seat portion in a folded state according to the present invention.

The folding of the stool body 103: by unscrewing the supporting legs 105 to release the connection between the supporting legs 105 and the supporting board 104, taking out the supporting board 104, stool cover 102 and the backrest, the stool cover 102 and the backrest 2 can be taken off the stool body 103 as a whole. Since the hollow cuboid formed by unfolding the stool body 103 is not limited by the supporting board 104, one pair of adjacent hard sandwich boards A and B, the other pair of adjacent hard sandwich boards C and D can be folded inward via the folding line 1033 and the notch 1032, as shown in FIGS. 11 and 12. When the two boards A and B and the two boards C and D fit with each other, it reaches the largest folding limitation to facilitate the storage of the folding stool of the present invention.

The unfolding of the stool body 103: after the stool body 103 is folded, unfolding outward the two hard sandwich boards A and B, and the other two hard sandwich boards C and D. When the two boards A and B and the other two boards C and D overlap with each other at the surface where the folding line locates, it reaches the largest unfolding limitation. At this moment, the stool body 103 is unfolded to from a hollow cuboid. Putting the supporting board 104 into the stool body 103 to make the second mounting through-holes 1041 in the supporting board 104 be corresponding to the first mounting through holes 1031 in the bottom of the stool body 103, and making the bolts 1051 in the supporting legs 105 pass through the first mounting through-holes 1031 and be connected to the second mounting through-holes 1041 via threaded connection, thus the supporting board 104 is connected to the bottom of the stool body 103 and the stool body 103 is unfolded and stabilized.

The above description is used to explain the present invention, but not to limit the present invention. The protection scope of the present invention is referred to the claims. Any modification is allowable under the protection scope of the present invention.

I claim:

1. A folding stool, comprising a seat portion (1) and a backrest (2), the backrest (2) consisting of a soft surface layer and a hard sandwich board wrapped in the soft surface layer, the seat portion (1) being a cuboid, and both an upper surface and four side surfaces of the cuboid consisting of the soft surface layer and the hard sandwich board wrapped in the soft surface layer;

wherein, a first hard sandwich board (201) in the backrest (2) is connected to a second hard sandwich board (101) under the upper surface of the seat portion (1) via a hinge device, the hinge device comprises a first hinge (3) and a second hinge (4) that are connected to each other rotatably, two first hinges (3) are respectively fixed on the second hard sandwich board (101) and the first hard sandwich board (201), the first hinge (3) comprises two ear portions provided along a longitudinal direction, the second hinge (4) comprises four ear portions provided symmetrically along the longitudinal direction and a transverse direction, two ear portions of the first hinge (3) on the second hard sandwich board (101) are connected to two ear portions provided along the longitudinal direction and located at a same side of the second hinge (4) by means of a rotary shaft (5), two ear portions of the first hinge (3) on the first hard sandwich board (201) are connected to the other two ear portions provided along the longitudinal direction of the second hinge (4) by means of another rotary shaft (5), a position limiting board (6) is fixed on a back surface of the second hinge (4), the position limiting board (6) comprises two longitudinal position limiting surfaces (601) opposite to each other, when the backrest (2) is rotated to be perpendicular to the upper surface of the seat portion (1) via the hinge device, the two longitudinal position limiting surfaces (601) of the position limiting board (6) are respectively used to limit the rotation of the second hinge (4) and the first hinge (3) on the first hard sandwich board (201), the first hinge (3) is a groove structure, the two ear portions are defined on two side walls (301) of the groove structure and are defined on end portions of the two side walls (301), a bottom of the groove structure is a connection portion (302), connection portions (302) of two first hinges (3) are respectively fixed to the second hard sandwich board (101) and the first hard sandwich board (201), and an end surface (303) of the groove structure located at a same side with the two ear portions are arranged correspondingly to the longitudinal position limiting surface (601) on the position limiting board (6).

2. The folding stool according to claim 1, wherein, one of the two ear portions of the first hinge (3) is arranged between two ear portions provided in the longitudinal direction of the second hinge (4), the other one of the two ear portions of the first hinge (3) is arranged outside corresponding ear portions of the second hinge (4), and positional relationship between the ear portions of the first hinge (3) on the first hard sandwich board and the corresponding ear portions of the second hinge (4) is the same as that between the ear portions of the first hinge (3) on the second hard sandwich board and the corresponding ear portions of the second hinge (4).

3. The folding stool according to claim 1, wherein, the second hinge (4) is an H-shaped structure, the four ear portions are symmetrically defined on two parallel walls (401) of the H-shaped structure and are defined on four end portions of the two parallel walls (401), a vertical connection portion (402) is arranged between the two parallel walls (401), a width of the vertical connection portion (402) is less than a distance between two ear portions defined on a single parallel wall (401), a height of the two parallel walls (401) is greater than a height of the vertical connection portion (402), and after the first hinge (3) and the second hinge (4) are connected via the rotary shaft (5), the ear portions of the first hinge (3) is above the vertical connection portion (402).

4. The folding stool according to any one of claim 1, wherein, the seat portion (1) comprises stool cover (102), a stool body (103) and a supporting board (104), the stool body (103) is a hollow cuboid when it is unfolded, each of the four side surfaces of the cuboid consisting of the soft surface layer and the hard sandwich board wrapped in the soft surface layer, the hollow cuboid is defined with an upper opening, a bottom of the hollow cuboid is the soft surface layer, the stool cover (102) is formed of the soft surface layer and the hard sandwich board wrapped in the soft surface layer, the stool cover (102) is covered on the unfolded stool body (103), and the supporting board (104) is supported in the unfolded stool body (103).

5. The folding stool according to claim 4, wherein, a plurality of first mounting through-holes (1031) are defined in the soft surface layer at the bottom of the stool body (103), a plurality of second mounting through-holes (1041) are defined in the supporting board (104), threads are defined on the second mounting through-holes (1041), a pull ring (1042) is defined on the supporting board (104), and the first mounting through-holes (1031) and the second mounting through-holes (1041) are arranged correspondingly for mounting bolts (1051) in supporting legs (105).

6. The folding stool according to claim 4, wherein, a gap region is defined between four hard sandwich boards in the four side surfaces of the hollow cuboid, the gap region is wrapped in the soft surface layer, there are at least two adjacent hard sandwich boards among the four hard sandwich boards are formed by two separate boards, and a notch (1032) and a fold line (1033) are defined between the two separate boards.

* * * * *